United States Patent [19]

Anderson

[11] Patent Number: 4,878,235

[45] Date of Patent: Oct. 31, 1989

[54] HIGH INTENSITY X-RAY SOURCE USING BELLOWS

[75] Inventor: Weston A. Anderson, Palo Alto, Calif.

[73] Assignee: Varian Associates, Inc., Palo Alto, Calif.

[21] Appl. No.: 160,223

[22] Filed: Feb. 25, 1988

[51] Int. Cl.[4] ..... H01J 35/04

[52] U.S. Cl. ..... 378/136; 378/125; 378/130; 378/141

[58] Field of Search ..... 378/125, 130, 132, 136, 378/141, 135, 104, 200

[56] References Cited

U.S. PATENT DOCUMENTS

| | | | |
|---|---|---|---|
| 1,160,177 | 11/1915 | Kelly | 378/141 |
| 2,209,963 | 8/1940 | Du Mond | 378/141 |
| 2,229,152 | 9/1938 | Walsweer | 378/127 |
| 2,290,226 | 7/1942 | Du Mond | 378/124 |
| 2,493,606 | 1/1950 | Waterton | 378/135 |
| 2,790,102 | 4/1957 | Atlee | 378/141 |
| 2,926,270 | 2/1960 | Zunick | 378/126 |
| 3,230,409 | 1/1966 | Farrell | 378/126 |
| 3,303,372 | 2/1967 | Gager | 378/122 |
| 3,331,978 | 7/1967 | Brown et al. | 378/130 |
| 3,619,696 | 11/1971 | DeLucia | 378/131 |
| 3,689,790 | 9/1972 | Haas et al. | 378/130 |
| 3,735,175 | 5/1973 | Blomgren, Jr. | 378/127 |
| 3,737,698 | 6/1973 | Carter | 378/124 |
| 3,753,020 | 8/1973 | Zingaro | 378/141 |
| 3,794,872 | 2/1974 | Haas et al. | 378/141 |
| 4,128,781 | 12/1978 | Flisikowski et al. | 378/135 |
| 4,336,476 | 6/1982 | Holland et al. | 378/125 |
| 4,417,171 | 11/1983 | Schmitmann | 378/131 |
| 4,608,707 | 8/1986 | Gabbay et al. | 378/132 |
| 4,788,705 | 11/1988 | Anderson | 378/121 |

FOREIGN PATENT DOCUMENTS

| | | | |
|---|---|---|---|
| 0187020 | 7/1986 | European Pat. Off. . | |
| 0061356 | 3/1986 | Japan | 378/135 |

*Primary Examiner*—Craig E. Church
*Assistant Examiner*—John C. Freeman
*Attorney, Agent, or Firm*—Stanley Z. Cole; Gerald M. Fisher; Terrence E. Dooher

[57] ABSTRACT

Several different embodiments of high-intensity rotating-anode X-ray are shown which use a liquid or fluid-cooled rotating-anode. No ferrofluid-type rotating joints or O-ring gasket-type seals are required so that the interior of the tube maintains a high vacuum without pumping. A bellows permits mechanical coupling to interior structures of the tube while providing a completely vacuum tight enclosure. All joints may be hard soldered or brazed together so the entire system can be baked at a high temperature during pumpdown.

6 Claims, 5 Drawing Sheets

HIGH INTENSITY X-RAY SOURCE USING BELLOWS

FIELD OF THE INVENTION

This invention pertains to a high intensity source of X-rays using a fluid cooled rotating anode, more particularly to a source incorporating a bellows to accommodate relative motions of the cathode and anode.

BACKGROUND OF THE INVENTION

The classic X-ray tubes have a thermionic cathode at one end and a fixed anode at the other end. Electrons emitted from the cathode are accelerated by a high potential and impact the anode thereby producing X-rays. The electron beam, which must be tightly focused to produce a high-definition image, produces extreme heating of the anode target. The power capability of this tube is limited by the conductive cooling of the anode target.

High intensity X-ray sources are in increasing demand for applications such as X-ray Lithography for Producing Integrated Circuits, Computerized Tomography for X-ray Imaging, and for X-ray Diffraction for Analyzing Materials. High intensity X-ray sources can be constructed by impinging a high intensity beam of electrons on an anode, but cooling the anode becomes a significant technical problem. A latter advance was the rotating-target tube in which the target is the surface of a metal disk spinning rapidly on bearings inside the vacuum envelope and driven by the rotor of an electric induction motor whose stator is outside the envelope. The rotating anode spreads the heat over an annular area of the target and provides much higher power for a short operating time, as in medical radiography. The ultimate cooling of the anode is mostly by thermal radiation in the high vacuum, so these tubes are inadequate for heavy duty operation. One has to wait for the massive anode to slowly cool.

U.S. Pat. No. 1,160,177 to Kelley discloses an X-ray which uses an externally applied cooling medium with a fixed anode. Some improvement in distributing the heat from the beam can be achieved by steering the electron beam to different parts of the anode. U.S. Pat. No. 2,229,152 to Walsweer and U.S. Pat. No. 4,336,476 to Holland disclose an anode sealed entirely in the vacuum which rotates in response to the field from coils exterior to the vacuum. The heat from the anode must be conducted through bearings irradiated through the vacuum to an external cap. U.S. Pat. No. 4,128,781 to Flisikowski et al. discloses an X-ray tube having a cathode rotatable relative to an anode. Electrons from a rotating cathode are incident on a stationary anode ring. The X-rays are emitted from different positions in space as a cathode is rotated. For most applications it is important that the X-rays be emitted from a fixed position in space.

U.S. Pat. Application Ser. No. 683,988 filed Dec. 12, 1984 by the inventor of the present invention, a continuation of which is now U.S. Pat. No. 4,788,705, describes methods by which the anode is rotated while the cathode is operationally fixed in space. One method is to have the rotating thermionic cathode emit along the axis of rotation and the electron beam is deflected by a stationary magnetic field to a stationary spot on the rotating anode. In another variation, the cathode is held stationary off axis by hanging on bearings from the rotating envelope and being held stationary by a magnetic or gravitational field.

U.S. Pat. Application Ser. No. 843,960 filed Mar. 25, 1986 by the inventor of the present invention, a continuation of which is now U.S. Pat. No. 4,821,305, describes an X-ray tube having the whole vacuum envelope rotate with the anode. The anode being part of the vacuum envelope, it can be cooled from the outside by liquid or air. The cathode also rotates. It is an axially symmetric band of photocathode surface which is illuminated by a focused, stationary spot of light entering the envelope through an auxiliary symmetric transparent window, part of the vacuum envelope. Photoelectrons from the cathode are focused, as by a stationary magnetic field, onto a small stationary spot through which the anode rotates.

Thus, there are many ways a high power X-ray tube can be designed to dissipate the heat over a large area of anode. However, nearly all involve a rotating seal in the form of a sliding 0-ring seal or a Ferrofluidic seal. These seals cause problems by limiting the rotation speed or life of the tube due to seal failure.

OBJECTS OF THE INVENTION

An object of the invention is to provide a high intensity source of X-rays which avoids the use of rotating seals.

SUMMARY OF THE INVENTION

These objects of the invention and other objects, features and advantages to become apparent as the specification progresses are accomplished by the invention according to which, briefly stated, a bellows type arrangement permits mechanical coupling to interior structures of the tube while providing a completely vacuum tight enclosure. All joints may be hard soldered or braced together so the entire system may be baked at high temperature during pump down. No ferrofluid-type rotating joints or 0-ring gasket-type seals are required so that the tube may be sealed off and the interior of the tube maintains a high vacuum without further pumping. The tube uses liquid or fluid-cooled rotating anode.

These and further constructional and operational characteristics of the invention will be more evident from the detailed description given hereinafter with reference to the figures of the accompanying drawings which illustrate one preferred embodiment and alternatives by way of non-limiting examples.

GLOSSARY

Figure 1:
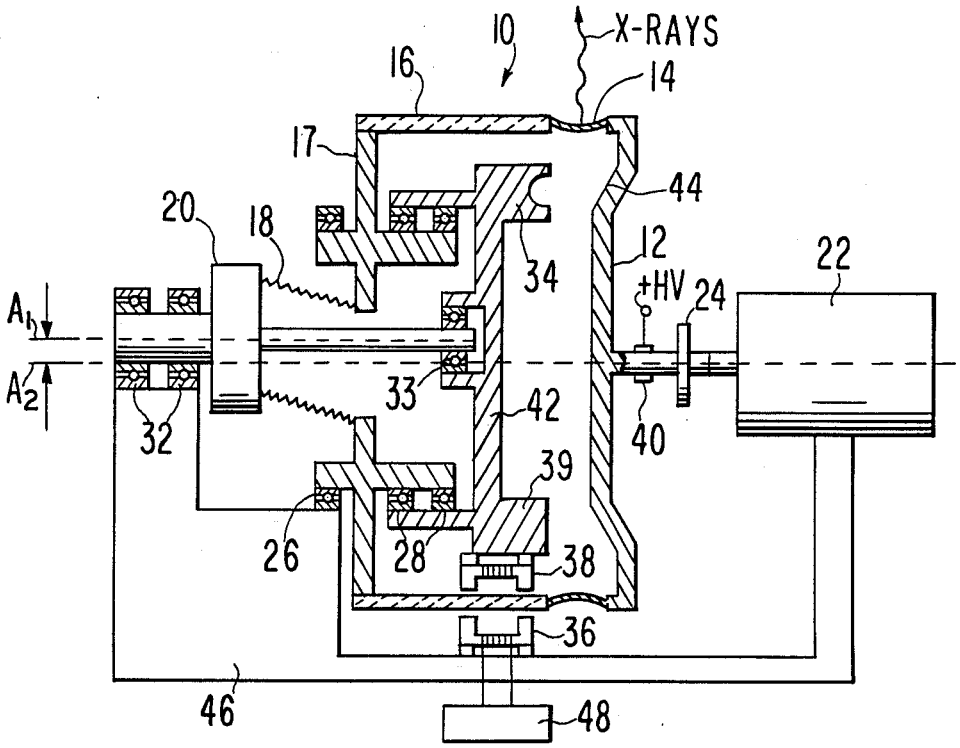
FIG. 1 shows a schematic sectional drawing of a first embodiment of the invention.

The following is a glossary of elements and structural members as referenced and employed in the present invention.

10 vacuum enclosing shell
12 anode support
14 window
16 insulating cylinder
17 cathode support
18 bellows
20 cathode stabilizer
22 motor
24 insulating coupling
26 shell bearings
28 internal bearings
32 external cathode stabilizer bearings
33 internal cathode stabilizer bearings
34 cathode
36 primary of transformer
38 secondary of transformer
39 stationary cathode member
40 slip ring
42 internal cathode support
44 anode
46 base
48 heater power supply
110 vacuum enclosing shell
112 anode support
114 window
116 insulating cylinder
118 bellows
122 motor
126 shell bearings
134 cathode
136 cathode support
138 heater power supply
140 vacuum feedthrough
142 pair of slip rings
144 anode
146 base
210 vacuum enclosing shell
214 window
216 insulating cylinder
218 bellows
222 motor
234 cathode
242 focus electrode
244 anode
246 coolant gland
248 bearings
300 rotary ceramic or glass insulator
302 fixed cathode
304 rotating anode
306 cathode support
308 fixed shaft
310 first set of two bearings
312 bearing support
314 second set of two bearings
316 support frame
318 glass-to-metal or ceramic-to-metal sealing ring
320 bellows
322 end cap
324 bearing
326 pair of outer bearings
328 slip ring
330 spring-loaded bearing
334 insulating ring
336 anode stator
338 shaft
340 coolant inflow passage
342 coolant outflow passage
344 rod
346 spring-loaded bearing
347 0-ring
348 metal ring
350 graphite face
352 silicon carbide ring
354 0-ring
356 collar
358 support ring
359 0-ring
360 pair of bearings
362 pulley
364 belt
366 drive pulley
368 motor
370 coolant manifold
372 insulating plate
374 secondary of heater transformer
376 primary of heater transformer
400 cathode assembly
402 shaft
404 pair of bearings
406 internal support
408 cathode positioner
410 shaft
412 spring-loaded bearing
414 bellows
416 cathode
418 insulator
420 shaft
422 ring bearing
424 cathode positioner

DETAILED DESCRIPTION OF THE PREFERRED EMBODIMENTS

Referring now to the drawings wherein reference numerals are used to designate parts throughout the various figures thereof, there is shown in FIG. 1, a vacuum enclosing shell 10, including an anode support 12, a window 14, an insulating cylinder 16, the cathode support 17, a bellows 18, and a cathode stabilizer 20. These parts can all be hard soldered or brazed together such that the enclosed volume can be pumped out and maintained under high vacuum conditions. A motor 22 rotates this whole shell 10 at a high angular speed of several thousand RPM's. As shown, the motor 22 supports one end of this structure through the insulating coupling 24 and the other end is supported by shell bearings 26 which have a rotational axis A2 common to that of the motor 22. In addition, internal bearings 28 are aligned on the same axis so that the internal cathode 34 can be maintained at a fixed position as the shell rotates. The cathode is constrained from rotating by the cathode stabilizer 20 on the axis A1 which is offset from the motor axis A2. In this sketch the two axes A1 and A2 are shown parallel to each other. However, the cathode stabilizer axis may also be tilted with respect to the motor axis and so long as the cathode stabilizer bearings 32 and 33 are properly supported and maintain a common axis with each other. In order to couple heater power to the cathode 34, a transformer with a primary 36 outside of the rotating shell is magnetically coupled through the insulating cylinder 16 to the secondary 38 of the transformer which is attached to the stationary cathode 39 member inside of the rotating shell 10. Power is thereby coupled from the outside to the interior cathode structure. The positive high voltage is applied to the anode support 12 by a slip ring 40 on the driving shaft. This voltage may be insulated from the motor by the insulating mechanical coupling 24. The negative supply may be coupled to the cathode through another slip ring or through bearings 26 and 28 or through bearings 32 and 33. Although the cathode stabilizer 20 rotates along with the rest of the structure, its axis is fixed with respect to the base and does not coincide with the motor axis. The internal cathode support 42 is constrained from rotating by its contact with the cathode stabilizer 20. In this configuration the cathode 34 is stationary with respect to the motor 22 so that the electron beam pattern provided can be rectangularly shaped if desired, permitting the bombardment pattern on the anode 44 also to be in the form a rectangle with the long axis along the radial direction. When such a pattern is viewed obliquely through the window, one can achieve a foreshortened view of the elongated pattern and thereby attaining effectively a small X-ray source spot size. This technique is used in order to spread the heat out along the radial direction of the anode 44 and thereby reduce the instantaneous heat load to the anode 44 and still obtain the small X-ray spot size. The motor 22, stabilizer bearings 32 and primary 36 are all mounted on a base 46.

Figure 2:
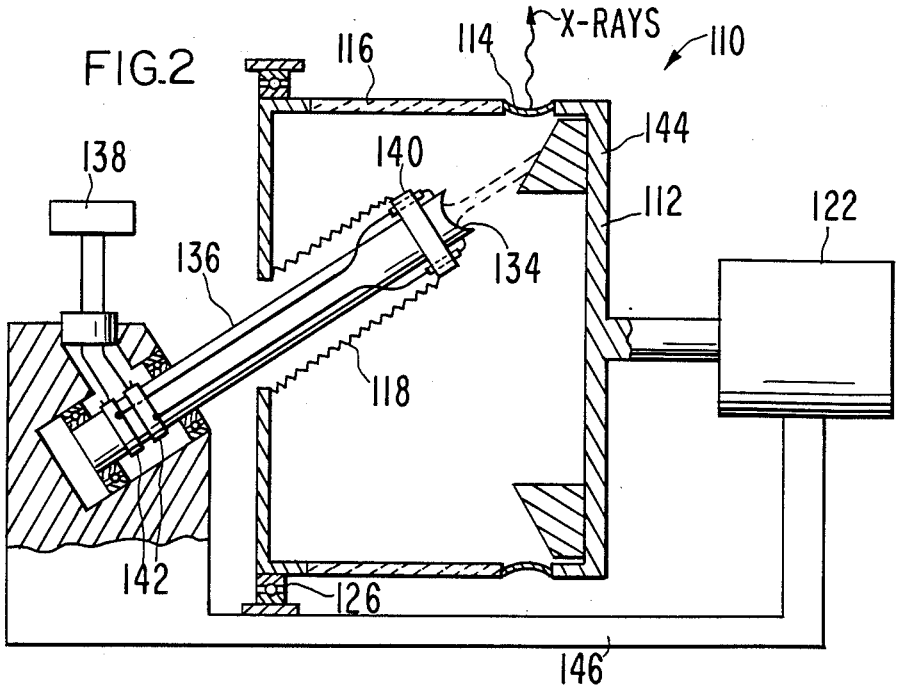
FIG. 2 shows a schematic sectional drawing a second embodiment of the invention.

Another X-ray tube configuration is sketched in FIG. 2. This configuration is much like that of FIG. 1 except the cathode 134 is directly attached to the cathode support member 136. The electrical power leads for the heater are coupled to the region outside the vacuum and to the power supply 138 through a standard vacuum feedthrough 140 and then coupled to the external heater current source through a pair of slip rings 142. Since the cathode 134 itself rotates relative to the anode in this configuration, one must use a cathode geometry that emits a circular electron beam pattern so that the X-ray pattern will be independent of the angular position of the cathode 134 or anode 144. With the proper electron optics, one can still achieve a reduction in the instantaneous anode power density by having the electrons impact the anode 144 at a substantial angle from the normal to the anode surface. By taking the X-rays off at the same angle but on the opposite side of the normal, one achieves the desired foreshortening of the X-ray spot size.

Figure 3:
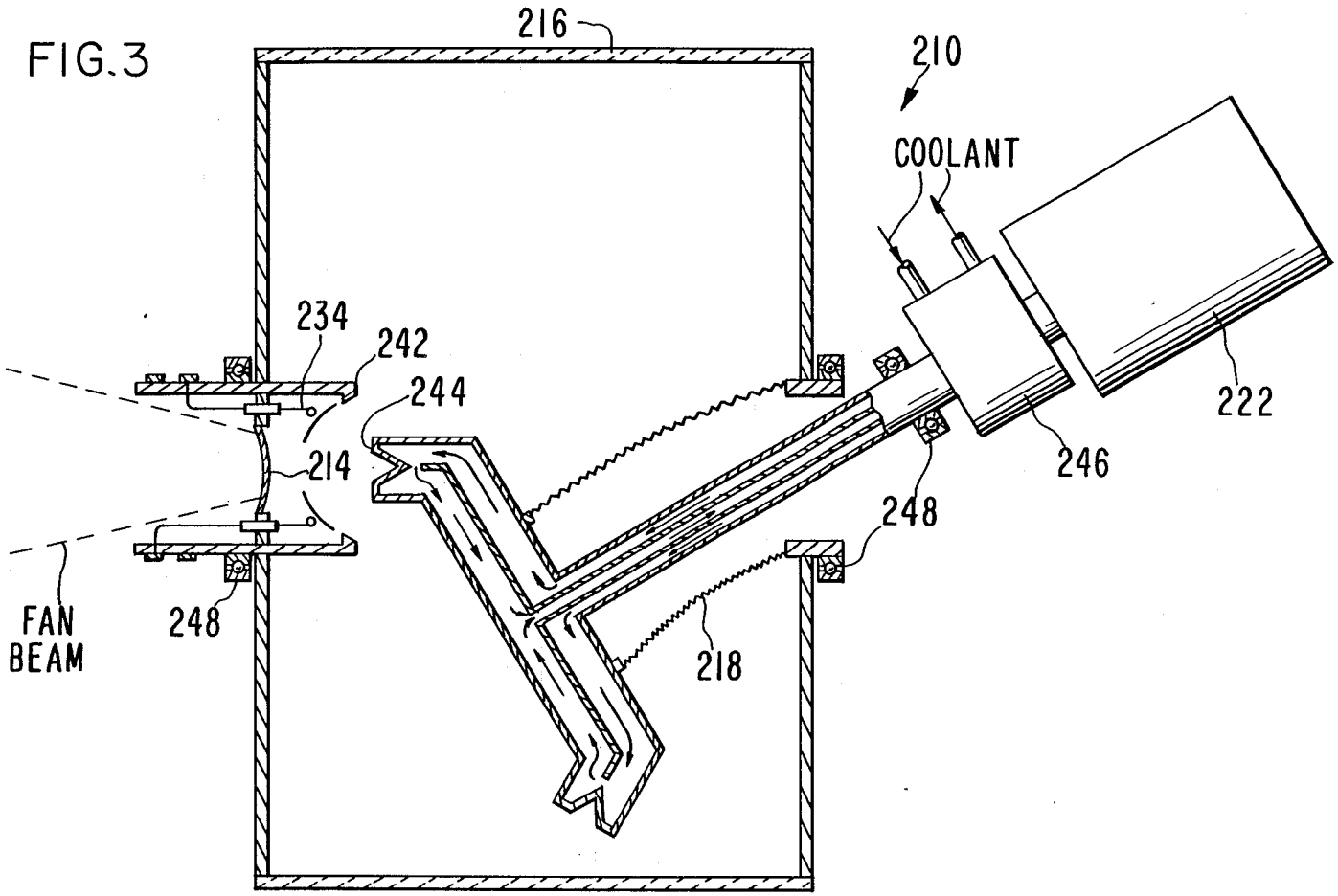
FIG. 3 shows a schematic sectional drawing of a third embodiment of the invention.

FIG. 3 shows a third configuration where the bellows 218 are used on the anode side of the tube rather than the cathode side. This permits the use of a small circular X-ray window 214. In this configuration the cathode 234 is in the form of a circle that surrounds the X-ray window 214. The electrons form a converging cone that is incident upon the anode 244. To reduce the instantaneous heat load on the anode, a V-groove anode configuration may be used. The V-groove permits a spreading of the instantaneous electron heating over a larger anode surface area. The X-rays are extracted through the X-ray window 214 so they leave the anode 244 surface at approximately the same angle that the electrons arrived permitting the proper foreshortening of the X-ray spot size. The V-groove geometry also permits a more symmetric distribution of the X-ray intensity and energies making this configuration a good candidate as a source for X-ray lithography. As in the embodiment of FIG. 2, feedthroughs are used in order to couple the heater current to the external world and slip rings are used to couple the current to the filament current source. The X-ray anode 244 is contained almost completely within the vacuum enclosure 210. It may be readily cooled by circulating a liquid coolant within the anode structure by bringing the liquid in and out through channels in the drive shaft. The coolant gland 246 permits one to circulate the fluid through an external heat exchanger. In all of the configurations an insulating coupling can be used as in FIG. 1 to electrically isolate the motor from the X-ray anode. Electrically insulating coolants should be used whenever the anode is not grounded. No internal bearings are contained in the embodiments shown in FIGS. 2 and 3 so that the vacuum bearing problems of prior rotating-anode X-ray tubes are eliminated.

Although fairly sharp bending of the bellows is shown in all of the sketches, one can readily go to smaller bending angles by extending the length of the structure. The bellows life will depend upon the bending angle, their length and size. In FIGS. 1 and 2 a cylindrical window is shown that traverses the entire circumference of the vacuum cylinder. In practice, this window may just be part of the insulating cylinder as materials such as alumina have low loss to X-rays as well as good insulating properties. Another question deals with the choice of coolant and the exact cooling configuration. The present generation of rotating anode X-ray tubes for medical use have balanced power supplies with the anode positive with respect to ground and the cathode negative with respect to ground. If the whole tube is immersed in oil, then one must be concerned about the drag of the oil. By confining the oil to the back of the anode region (which is compatible with all three configurations), then one would expect very little drag by the oil, particularly if the oil is fed in and out close to the axis of rotation. The remainder of the tube could easily be cooled by air or another gas.

Figure 4:
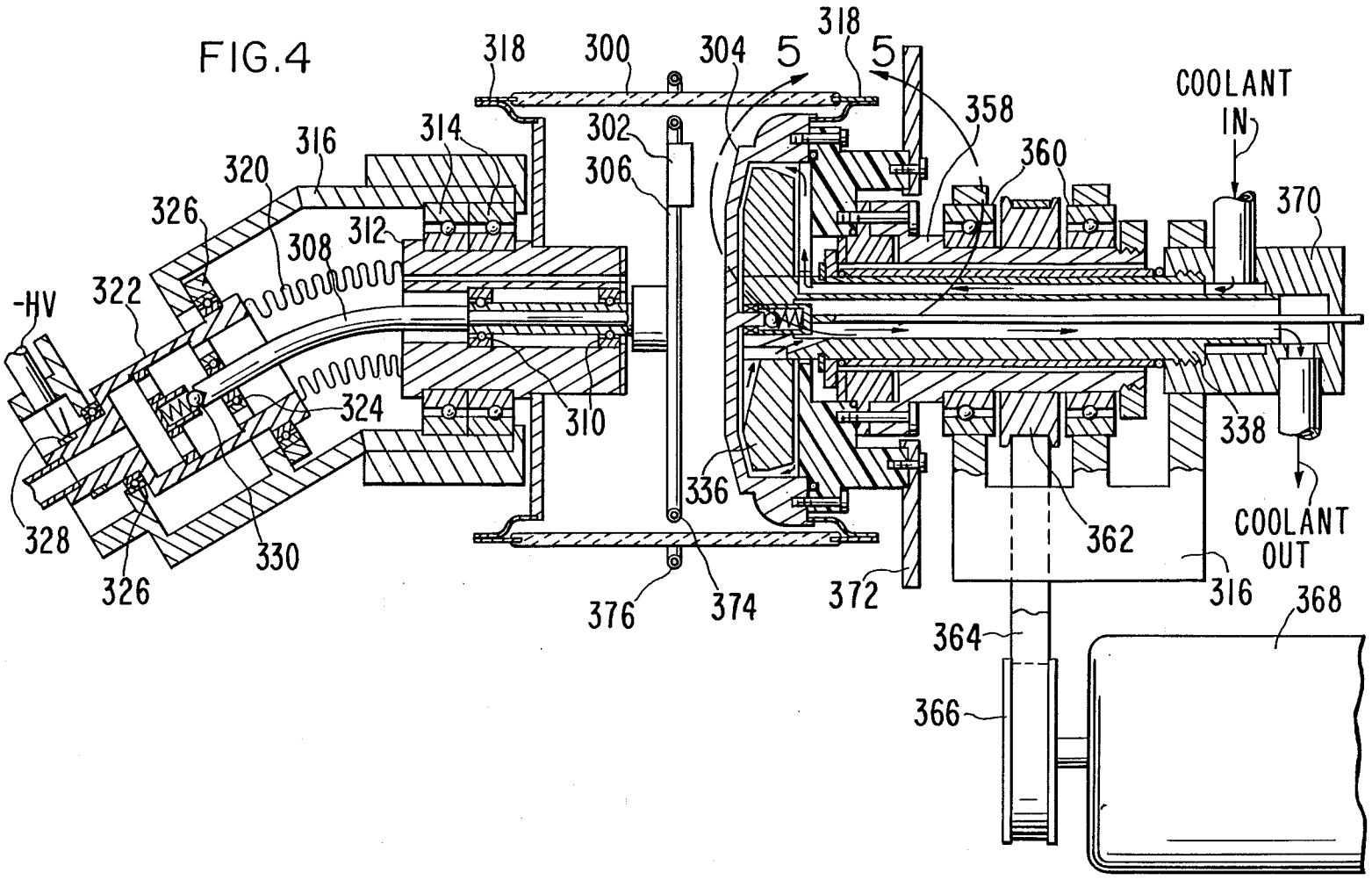
FIG. 4 shows a schematic sectional drawing of a fourth embodiment of the invention.

There is shown in FIG. 4 an embodiment similar to that disclosed in FIG. 1. Here the bellows is bent. The advantage of this arrangement is that for a given offset, one provides less stress to the bellows, and results in longer bellow lifetimes since each point on the bellows rotates in a plane normal to the curved centerline of the bellows. Here a shaft 308 extends through the bearings 310 and 314 that support the cathode and bends to follow the contour of the bellows. At the end is a spring-loaded ball contact that locks the cathode in place so that it does not rotate and provides the dc path for the anode to cathode current. As was shown in the previous embodiments, heater current is provided by a thru-the-wall transformer that magnetically couples ac power from the region outside of the rotating ceramic cylinder to the inside coil which in turn is connected to the cathode heater. Experiments have been done that demonstrate such a transformer system operating at 13.56 MHz can provide adequate power to the heater.

FIG. 4 also shows a way of cooling the backside of the anode which was not explicitly shown in any of the embodiments above. Several cooling arrangements were shown in an earlier disclosure which has now been filed as U.S. Pat. Application Ser. No. 06/683,988 referred to above.

Figure 5:
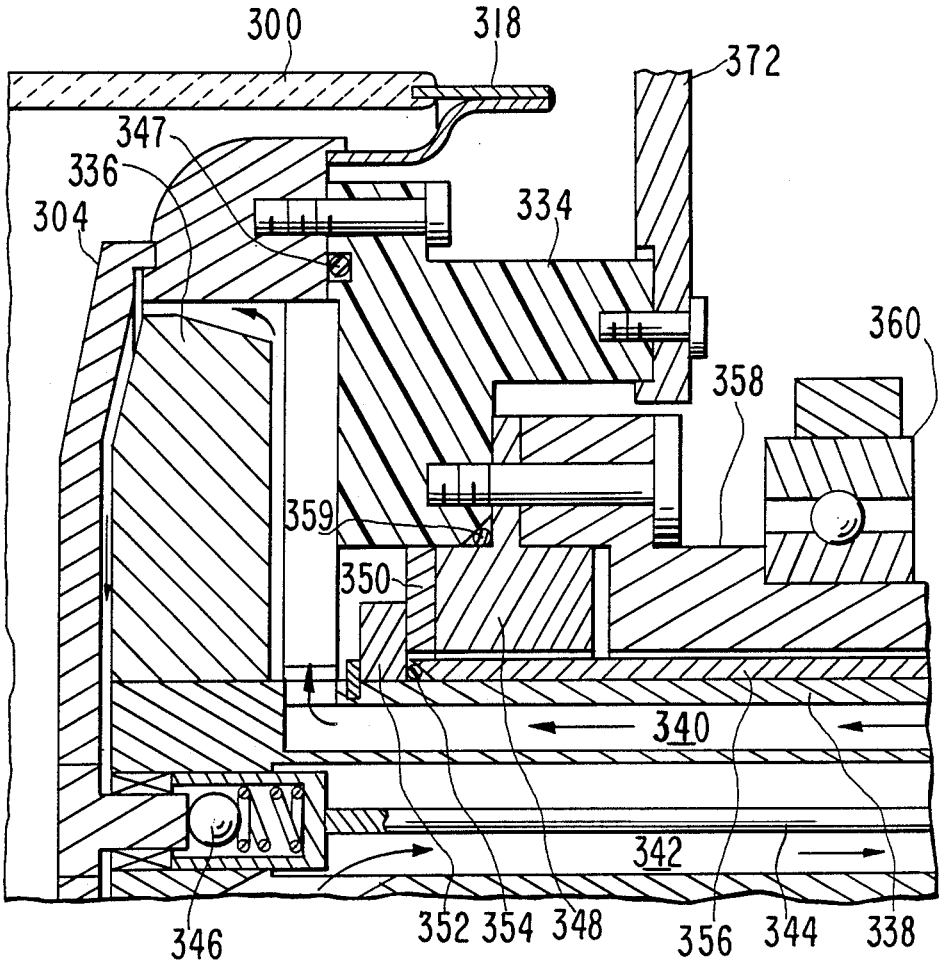
FIG. 5 shows a blow-up of a part of FIG. 4 encompassed by the line 5—5 of FIG. 4.

The tube of FIG. 4 has a rotating glass or ceramic insulator 300, a fixed cathode 302 and a rotating anode 304. The cathode 302 is mounted on a cathode support 306 which is attached to a fixed shaft 308. A first set of two bearings 310, allow the shaft 308 to remain fixed while the bearing support 312 rotates around it. A second set of two bearings 314 separates the rotating bearing support 312 from the support frame 316. With a glass tube envelope 300 a sealing ring 318 at both ends provide a glass-to-metal seal. The bearing support 312 is also sealed to the bellows 320. An opposite end of the bellows is sealed to the end cap 322. Within the end cap 322 an inner bearing 324 constrains the motion of the fixed shaft 308, thereby permitting the end cap 322 and bellows 320 to rotate around the shaft 308. The end cap 322 is mounted on the support frame 316 with a pair of bearings 326. Negative high voltage is fed to the cathode via a slip ring 328. Electrical contact is maintained between the end cap 322 and the shaft 308 with a spring-loaded ball 330. FIG. 5 shows additional detail of the anode end of the tube of FIG. 4.

The rotating glass insulator 300 is attached to the anode 304 with a second sealing ring 318. The anode 304 is attached to an insulating ring 334 made of a suitable plastic or ceramic insulator. Within the anode 304, a stator 336, supported by the shaft 338 is used to divert coolant around the inside of the anode to achieve maximum cooling efficiency. The shaft 338 is kept from rotating by attachment of the coolant manifold 370 at its end to the support frame 316. Within the shaft 338 there are passages for inflow 340 and outflow 342 of coolant to the anode 304. A rod 344 down the center of the shaft 338 maintains positive electric potential on the anode 304 via a spring-loaded ball 346. An 0-ring 347 provides a coolant seal between the insulating ring 334 and the back of the anode 304. A metal ring 348 attached to the outside end of the insulating ring 334 has a graphite face 350. The metal ring 348 and graphite face 350 are part of the rotating assembly. A stationary lapped silicon carbide ring 352 is in sliding contact with the graphite face 350 to provide a rotating water-tight seal. A seal between the ring 352 and the shaft 338 is provided with an 0-ring 354 compressed by collar 356. A cylindrical bearing support ring 358 is mechanically attached to both the ring 348 and the insulating ring 334. An 0-ring 359 provides the coolant seal between metal ring 348 and insulating ring 334. The cylindrical bearing support ring 358 is isolated from the frame 316 with a pair of bearings 360.

As shown in FIG. 4, a pulley 362 is also attached to the cylindrical bearing support ring 358 between the pair of bearings 360. A belt 364 driven by a drive pulley 366 and motor 368 is used to drive the pulley 362 and the anode assembly. At the outer end of the shaft 338, a coolant manifold 370 is used to distribute the coolant and support the shaft 338. An insulating plate 372 is attached to the insulating ring 334 to prevent arcing between the sealing ring 318 and parts of the frame 316. A single turn secondary coil 374 attached to the cathode support 306 is used to power the heater for the cathode. The primary 376 located outside the tube is concentric with the secondary and operates at 13.56 MHz.

Figure 6:
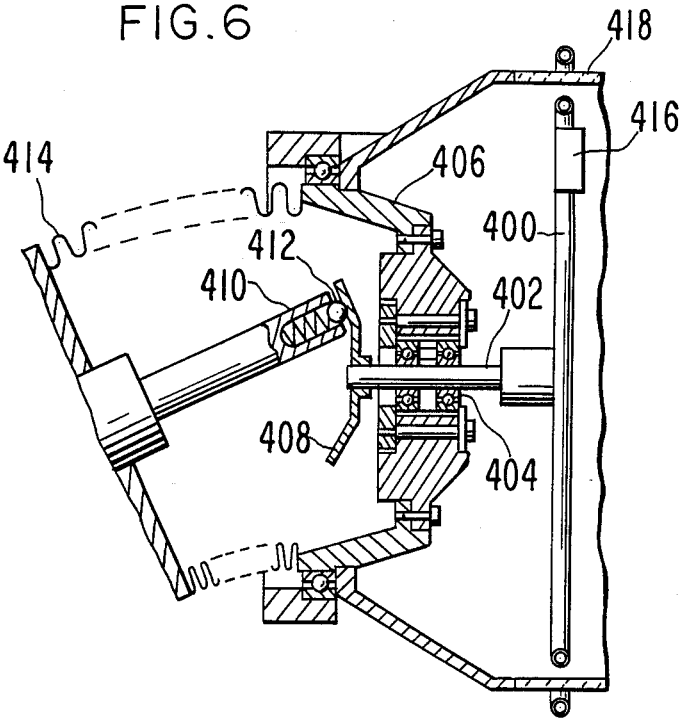
FIG. 6 shows a schematic sectional drawing of an alternate embodiment of the tube of FIG. 4.

In an alternate embodiment shown in FIG. 6, the cathode assembly 400 is mounted via a shaft 402 and pair of bearings 404 to an internal support 406. At the opposite end of the shaft 402, a cathode positioner 408 is held fixed in space by a shaft 410 having a springloaded bearing 412. The shaft 410 rotates with the bellows 414 which is attached to the rotating insulator 418 and anode as in the previous embodiment. The cathode 416 is fixed in space and decoupled from the motion of the shaft 410 by the bearing 412.

Figure 7:
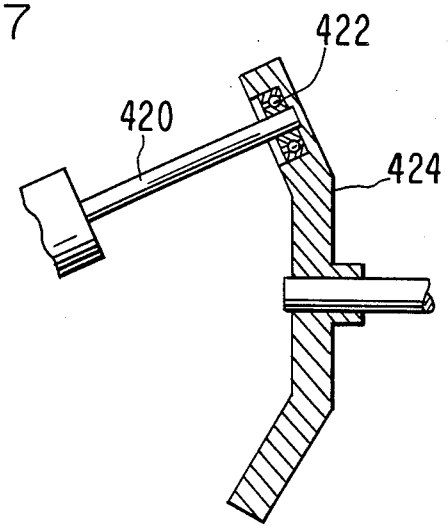
FIG. 7 shows a schematic sectional drawing of alternate embodiment of the tube of FIG. 6.

In another alternate embodiment shown in FIG. 7, the shaft 410 is replaced by the shaft 420 and the cathode positioner 408 is replaced by the cathode positioner 424. The functions of the shaft and cathode positioner remain the same, but a ring bearing 422 fitted into the cathode positioner 424 provides for relative rotation of the rod 420.

The bellows used in such a tube must be compatible with bakeout in a high vacuum environment and with continuous flexure during rotation. Such bellows are generally stainless steel or inconel bellows with welded joints at flexure points. (Sources of supply are: the Metal Bellows Co., 1075 Providence Hwy., Sharon, Mass. 02067; John Crane-Houdaille, Inc., 6400 West Oakton Street, Morton Grove, Ill. 60053).

This invention is not limited to the preferred embodiment and alternatives heretofore described, to which variations and improvements may be made including mechanically and electrically equivalent modifications to component parts, without departing from the scope of protection of the present patent and true spirit of the invention, the characteristics of which are summarized in the following claims.

What is claimed is:

1. An X-ray tube comprising:

a frame;

a vacuum chamber rotatably mounted on said frame, a first portion of said vacuum chamber being mounted on said frame for rotation about a first axis fixed with reference to said frame, a second portion of said vacuum chamber being mounted on said frame for rotation about a second axis that intersects said first axis at a single point, said first portion of said vacuum chamber being adapted to transmit rotary motion to said vacuum chamber;

a bellows having a curved centerline, said bellows connecting said first portion to said second portion so that said vacuum chamber is formed;

an anode mounted in said first portion of said vacuum chamber and fixed relative to said chamber;

a rigid member for supporting a cathode, said rigid member having an elongated portion extending into said bellows and having a centerline, the centerline in a first portion of said elongated portion coinciding with said first axis and the centerline in a second portion of said elongated portion coinciding with said second axis;

a first bearing means disposed around said first portion of said elongated portion and concentric with said first axis;

a second bearing means disposed around said second portion of said elongated portion and concentric with said second axis, said first bearing means and said second bearings means permitting the rotation of said vacuum chamber while constraining said rigid member in a fixed position with respect to said frame;

a cathode mounted on said rigid member in said vacuum chamber in opposition to said anode; and means for heating said cathode.

2. The X-ray tube of claim 1 wherein said means for heating said cathode comprises a transformer, a primary of said transformer being located outside said vacuum chamber and a secondary of said transformer being mounted on said cathode support means.

3. The X-ray tube of claim 1 wherein said curved centerline of said bellows coincides with the centerline of a third portion of said elongated portion, said third portion being between said first portion of said elongated member and said second portion of said elongated member.

4. The X-ray tube of claim 1 wherein said second portion of said vacuum chamber comprises a member for pressing against a spring loaded ball for contacting an end of said second portion of said elongated member to transmit an electrical potential to said cathode.

5. The tube of claim 1 further including a hollow shaft coaxial with said first axis and fixed to said frame for conveying coolant to said anode.

6. The tube of claim 5 further including a stator attached to said shaft, said stator being disposed in a recess in said anode to form a passage for conveying coolant.

* * * * *